United States Patent [19]

Angermann

[11] 4,177,543

[45] Dec. 11, 1979

[54] DISPLAY CASKET

[76] Inventor: Manfred E. Angermann, Rte. 5, Box 465 Geneva Oaks Rd., Lake Geneva, Wis. 53147

[21] Appl. No.: 919,232

[22] Filed: Jun. 26, 1978

[51] Int. Cl.[2] ..... A61G 17/00

[52] U.S. Cl. ..... 27/35

[58] Field of Search ..... 27/35, 2, 3, 6, 7, 19, 27/27

[56] References Cited

U.S. PATENT DOCUMENTS

| | | | |
|---|---|---|---|
| 2,289,406 | 7/1942 | Beranek | 27/35 |
| 2,916,797 | 12/1959 | McCombs | 27/35 |
| 3,133,334 | 5/1964 | Johnsen | 27/27 |
| 3,810,282 | 5/1974 | Doggett | 27/35 |
| 4,139,929 | 2/1979 | Angermann | 27/35 |

*Primary Examiner*—John D. Yasko

*Attorney, Agent, or Firm*—Wegner, Stellman, McCord, Wiles & Wood

[57] ABSTRACT

A display casket for removably holding a body display container having a continuous lateral flange around its upper periphery with the casket having a casing with front, rear and side walls, a bottom and a lid, with each of the walls having an upper surface to engage under the lateral flange of the display container for support thereof. The display casket has a first set of hinges with removable hinge pins pivotally mounting the lid to the rear wall. A second hinge interconnects the casing and the lower edge of the rear wall for downward pivoting of the rear wall, and a releasable latch holds the rear wall in upright position. Pivot structure coacts between the front wall and the lid to enable reverse inclination of the lid for insertion and removal of a body display container relative to the casket through an opening provided by downward pivoting of the rear wall.

9 Claims, 5 Drawing Figures

4.
5.
C
D
10
11
12
14
15
16
20
24
25
30
31
32
35
36
40
41
42
43
44
45
46
50
51
60
61
62
70
71
72
73

51
15
45
46
25
50
40
44
33
72
32
10
D
10
C
24
70
14
36

15
41
46
63
61
51
50
25
33
30
C
D
11
24
10
70
32
36
14
20
41

DISPLAY CASKET

CROSS-REFERENCE TO RELATED APPLICATION

This application relates to an improvement in a display unit as shown in a copending application of the applicant, Ser. No. 785,320, filed Apr. 7, 1977 now U.S. Pat. No. 4,139,929 and, additionally, the instant application utilizes a body display container having the structure shown in said prior application and which is associated with additional structure for final disposal in the manner described in said prior application.

BACKGROUND OF THE INVENTION

This invention pertains to a display casket for removably holding a body display container wherein the display casket may have a conventional appearance and with insertion and removal of a display container through an opening provided by a pivoted rear wall of the display casket.

The prior art includes many examples of attempts to provide a body display and burial system wherein a conventional-appearing casket may be used for display and a separate body-holding container may, thereafter, be removed from the casket for burial or other disposal and with repeated use of the casket. Examples of such attempts disclosed in patents include Beranek U.S. Pat. No. 2,289,406, Johnsen U.S. Pat. No. 3,133,334, Doggett U.S. Pat. No. 3,810,282, and Havey U.S. Pat. No. 4,063,337. Except for the Doggett patent, these patents have casket and body-holding structure in which the one or the other thereof must be lifted or lowered for separation after display or the use of complicated structure, such as transport rollers shown in Johnsen. Doggett has several embodiments which do include lifting or lowering of the units for separation, but does diagrammatically illustrate removal of a body-holding container from an end of the casket. All of the above patents disclose structures which involve cumbersome handling of the body display container in insertion and removal relative to the casket and with a likelihood of possibly dropping a heavy container with body during the handling.

SUMMARY OF THE INVENTION

A primary feature of the invention disclosed herein is to provide a display casket having the basic structure and external appearance of a conventional casket but which provides for support of a removable body display container and with structure facilitating insertion and removal of the container relative to the casing of the casket through the rear of the casket whereby the container may be easily handled without possibility of accidents, such as dropping of the container.

In carrying out the foregoing, the primary object of the invention is to provide a display unit, such as a casket, for holding a removable display container, with the container having a continuous lateral flange around its periphery comprising a casing with a front wall, side walls, a bottom and a lid, a support member on each of the walls to support said container by engaging under parts of said lateral flange, and movable means at the rear of the casket having a first position to engage under and support a part of said lateral flange and a second position away from said lateral flange to permit slidable removal of the display container from the rear of the casket.

Still another object of the invention is to provide a display casket, as defined in the preceding paragraph, wherein the movable means at the rear of the casket comprises a rear wall hinged along its lower edge to the casing of the casket for downward pivoting thereof and with the rear wall carrying hinge means associated with the lid to permit opening of the lid for body viewing. The hinge means includes removable hinge pins whereby the rear wall may be separated from the lid to permit downward pivoting of the latter and pivot means acting between the front wall and the lid permit reverse inclination of the lid to facilitate insertion and removal of the body display container through an opening provided by downward pivoting of the rear wall.

DESCRIPTION OF THE PREFERRED EMBODIMENT

Figures 1, 2, 3:
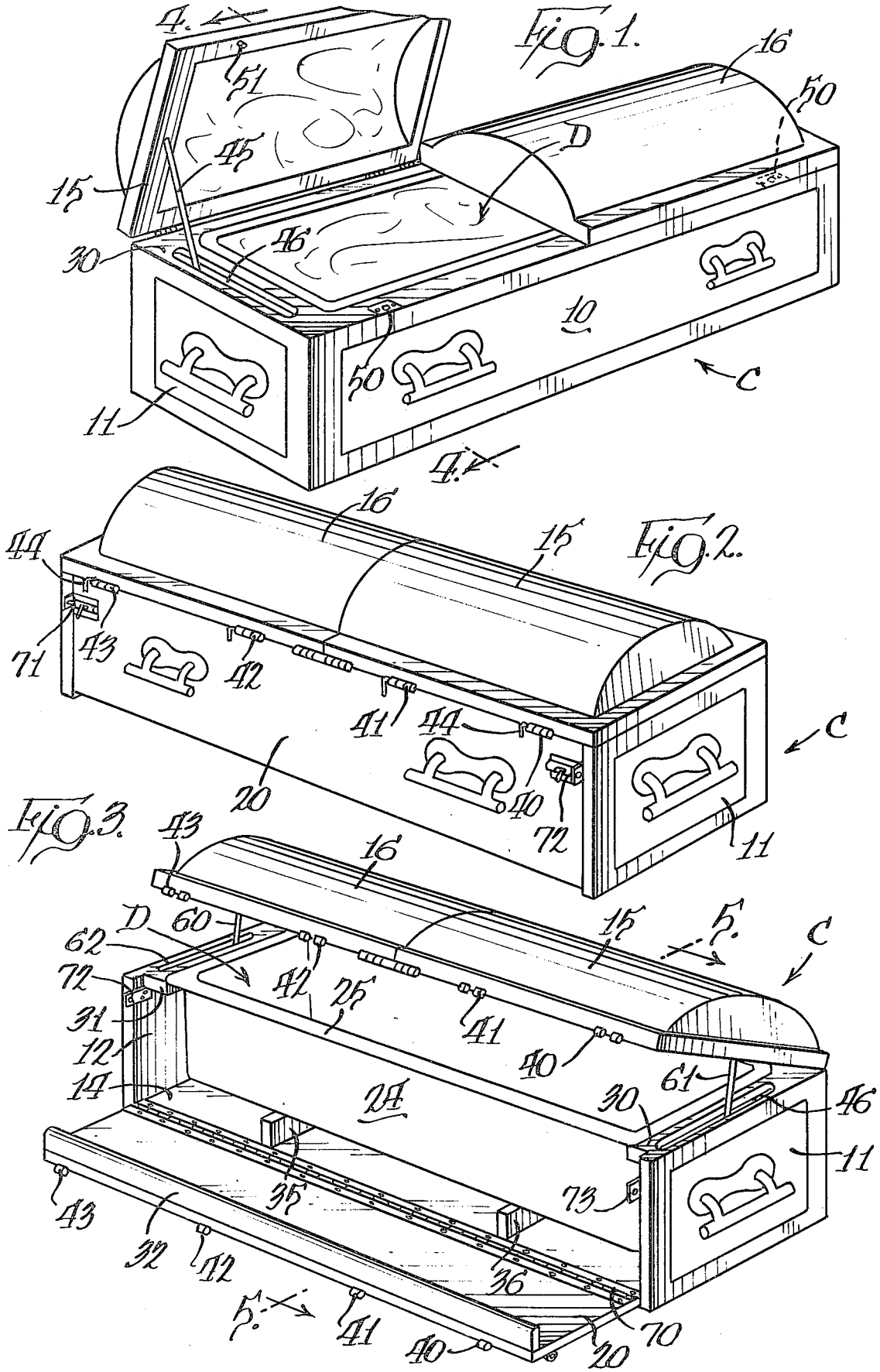
FIG. 1 is a perspective view of the display casket with a part of the two-part lid open for body viewing.
FIG. 2 is a rear perspective elevational view of the display casket with the lid completely closed.
FIG. 3 is a view, similar to FIG. 2, showing the display casket with the parts positioned to facilitate insertion and removal of a display container.
Figure 4:
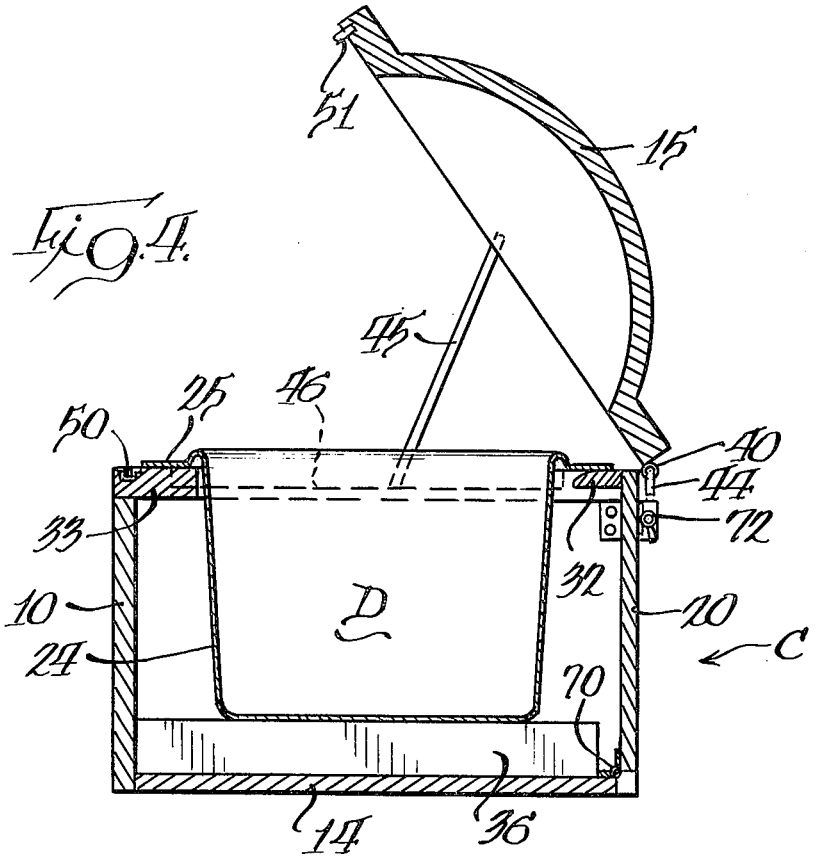
FIG. 4 is a vertical section, taken generally along line 4—4 in FIG. 1.

The display casket, indicated generally at C, has a casing with a front wall 10, end walls 11 and 12, a bottom 14 and a two-part lid with lid sections 15 and 16. A pivotal rear wall 20 completes the casing and with the walls all having exterior treatment including handle structure to provide a conventional casket in appearance.

For display, the display casket houses a body display container, indicated generally at D, which has a base with a four-sided upstanding wall 24 and a peripheral lateral flange 25 extending outwardly from the upper edge of said wall. The display container D is fully described and the use thereof in association with structure after removal from the display casket is fully disclosed in said prior application of the applicant and the disclosure thereof is incorporated herein by reference. Each of the display casket walls 10, 11, 12, and 20 has means at the upper end thereof for supporting engagement underneath the continuous lateral peripheral flange 25 of the display container D. This means comprises lateral support members 30 and 31 extending inwardly from the upper ends of the end walls 11 and 12, a support member 32 extending inwardly from the rear wall 20 and a front support member 33 extending inwardly from the front wall 10. Additionally, the bottom 14 of the display casket has a pair of upstanding support members 35 and 36 which engage the bottom of the display container D.

The display casket is shown positioned for body display in FIG. 1 wherein the lid section 15 is inclined upwardly, with the lid section 16 also having the capability for upward pivoting but shown closed in FIG. 1. This pivoting action is provided by hinge means interconnecting the casket rear wall 20 and the lid sections. This hinge means includes hinges 40 and 41 associated with the lid section 15 and hinges 42 and 43 associated with the lid section 16. Each of these hinges has a removable hinge pin 44 to enable separation of the lid from the rear wall 20 for a purpose to be described.

The lid section 15 can be retained in an elevated inclined body viewing position by means of a rod 45 which is pivotally mounted at one end to the support member 30 attached to the end wall 11 and which can move between the operative position shown in FIG. 1 and a storage position within an elongate groove 46 formed in the support member 30.

Figure 5:
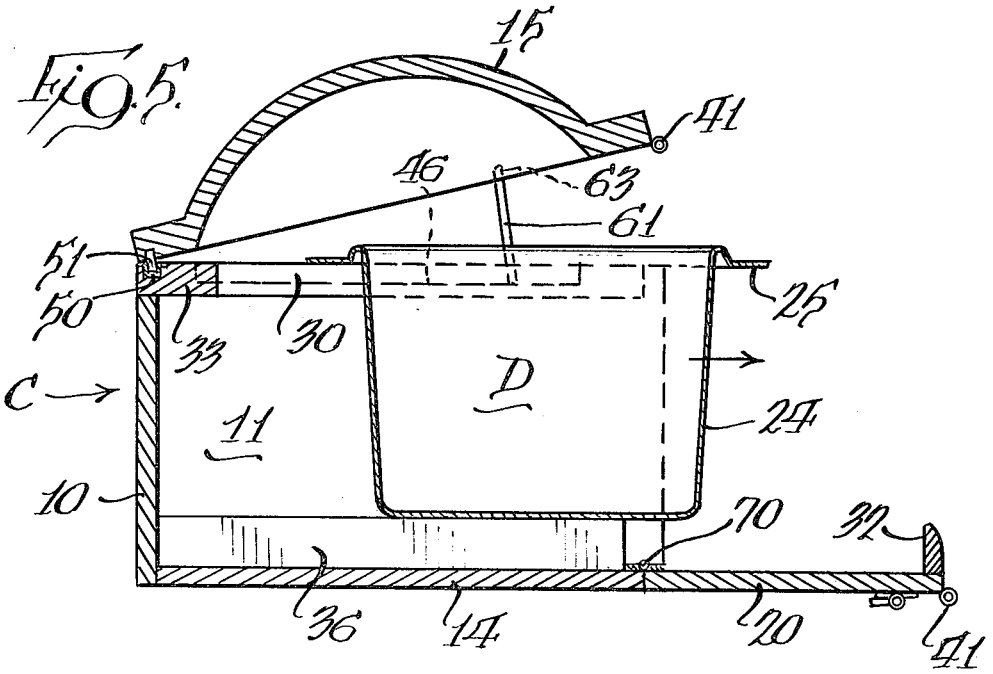
FIG. 5 is a view, similar to FIG. 4 and taken generally along the line 5—5 in FIG. 3 to show positioning of the parts with a display container partially removed.

For insertion and removal of a body display container D, the lid sections 15 and 16 can be moved to a position of reverse inclination, as shown in FIGS. 3 and 5. The lid sections can assume this position because of pivot means associated with the lid and the front wall 10. As shown, the pivot means includes a pair of recesses 50 formed in the top surface of the front wall in spaced-apart relation lengthwise of the casket and a pair of pins 51 extending downwardly from the front lower surface of the lid sections to loosely fit in the recesses 50. Upon removal of the hinge pins 44 from the hinges 40–43, the casket lid is free for movement to a reversely-inclined position and applying of a lifting force thereto moves the lid to the position shown in FIG. 3 with the front edge of the lid pivoting as guided by the pivot means 50,51. In order to have uniform movement of the two-part lid having lid sections 15 and 16, there is a connecting hinge 55 which assures movement thereof together to the position shown in FIG. 3. The two hinge leaves of hinge 55 are arranged in side-by-side relation to have one hinge leaf connected to each of the lid sections, which permits pivoting of the lid section 15 to the viewing position of FIG. 1, independently of the lid section 16.

The lid is held in the reverse inclination position of FIGS. 3 and 5 by a pair of pivoted rods 60 and 61 which have a storage position within the groove 46 in the end wall 11 and a similar groove 62 in the end wall 12. These pivoted rods can move between a storage position within the grooves and an operative position engageable at their upper ends within suitable recesses 63 formed in the underside of the lid sections.

The rear wall 20 is pivotally connected to the bottom 14 of the casket casing by an elongate hinge 70 which enables movement of the rear wall 20 from the closed position, shown in FIG. 2 to a downwardly-pivoted position for opening the rear of the casket as shown in FIGS. 3 and 5. The rear wall 20 can be held in closed position by a pair of draw-bolt latches 71 and 72 which engage keepers 72 and 73 on the casket end walls. The latches are shown holding the rear wall in closed position in FIG. 2.

In use of the display casket, the casket may be positioned, as shown in FIG. 1, for viewing of the body. At a later time, removal of the body display container D involves a series of steps. The casket lid section 15 is closed and then all of the hinge pins 44 are removed. This permits raising of the casket lid sections 15 and 16 to a reverse inclined position and holding thereof by positioning of the rods 60 and 61. The latches 70 and 71 are released and the rear wall 20 is pivoted downwardly.

The body display container D can then be moved rearwardly out of the casket and associated with a cover or other structure for burial, cremation, or other final disposal. The access to the entire length of the display container enables a firm grasp by two or more persons to assure that the display container is handled carefully in transfer out of the display casket C. Subsequently, another display container may be placed within the display casket and the casket closed back to the position of FIG. 1 by a reversal of the steps described above.

I claim:

1. A display casket for removably holding a body display container having a continuous lateral flange around its upper periphery comprising, a casing with front, rear and side walls, a bottom and a lid to have the appearance of a conventional casket, each of said walls having an upper surface to engage under said lateral flange for support of the display container, first hinge means with a removable hinge pin pivotally mounting said lid to the rear wall, second hinge means interconnecting said casing and the lower edge of the rear wall for downward pivoting of the rear wall, releasable latch means for holding the rear wall in upright position, and pivot means acting between said front wall and the lid to enable reverse inclination of the lid for insertion and removal of a body display container through an opening provided by downward pivoting of the rear wall.

2. A display unit for a removable display container capable of holding a body comprising: a casing with front, rear and side walls, a bottom, and a lid; first pivot means at the rear of the unit mounting the lid to said rear wall for movement between a closed position and an inclined forwardly open body-viewing position; second pivot means at the front of the unit mounting said cover for movement to an inclined rearwardly open position; and third pivot means along the lower edge of said rear wall mounting the rear wall for downward pivoting to expose the entire length of said display container for removal rearwardly of said display unit; said first pivot means including structure for disconnection thereof from the lid and rear wall to permit said downward pivoting of the rear wall.

3. A display unit as defined in claim 2 wherein said display container has a continuous lateral flange around its upper periphery; and means on said front, rear, and side walls for engaging under said flange for support of said container with said means on the rear wall moving out from under said flange as the rear wall pivots downwardly.

4. A display unit as defined in claim 2 including releasable latch means for holding said rear wall in closed position.

5. A display unit as defined in claim 2 wherein said first pivot means includes a series of spaced-apart hinges having their hinge pins in coaxial relation, and said hinge pins being removable to provide said disconnection structure.

6. A display unit as defined in claim 2 wherein said second pivot means includes a pair of recesses on the top of said front wall and a pair of pins on the underside of the lid engageable one in each of said recesses.

7. A display casket for holding a removable display container with said container having a continuous lateral flange around its periphery comprising, a casing with a front wall, side walls, a bottom and a lid, a support member on each of said walls to support said container by engaging under parts of said lateral flange, and movable means at the rear of the casket having a first position to engage under and support a part of said lateral flange and a second position away from said lateral flange to permit slidable removal of the display container from the rear of the casket.

8. A display casket as defined in claim 7 wherein said casket has a rear wall carrying said movable means, means mounting said rear wall for pivotal movement, and disengageable pivot means mounting said lid to the rear wall.

9. A display casket for removably holding a body display container having a continuous lateral flange around its upper periphery comprising, a casing with front, rear and side walls, a bottom and a two-part lid to have the appearance of a conventional casket, each of said walls having an upper surface adapted to engage under said lateral flange for support of the display container, a first set of hinges with removable hinge pins pivotally mounting said two-part lid to the rear wall to enable upward pivoting of the lid to an inclined position for body viewing, second hinge means interconnecting said casing and the lower edge of the rear wall for downward pivoting of the rear wall, releasable latch means for holding the rear wall in upright position, and pivot means including recesses in the top wall and pins on the two-part lid to enable reverse inclination of the two-part lid for insertion and removal of a body display container through an opening provided by downward pivoting of the rear wall.

* * * * *